US009320933B2

(12) United States Patent
Kessler

(10) Patent No.: US 9,320,933 B2
(45) Date of Patent: Apr. 26, 2016

(54) WEIGHTED EXERCISE HOOPS

(75) Inventor: George M. Kessler, Taftville, CT (US)

(73) Assignee: Fitness EM, LLC, Uxbridge, MA (US)

( * ) Notice: Subject to any disclaimer, the term of this patent is extended or adjusted under 35 U.S.C. 154(b) by 728 days.

(21) Appl. No.: 13/330,761

(22) Filed: Dec. 20, 2011

(65) Prior Publication Data

US 2012/0157272 A1 Jun. 21, 2012

Related U.S. Application Data

(60) Provisional application No. 61/425,345, filed on Dec. 21, 2010.

(51) Int. Cl.
*A63B 19/00* (2006.01)
*A63B 21/06* (2006.01)

(52) U.S. Cl.
CPC ..... *A63B 19/00* (2013.01); *A63B 21/0608* (2013.01)

(58) Field of Classification Search
CPC ..... A63B 19/00; A63B 21/0608
USPC ..... 482/110, 131–132; 446/28, 236, 446/242–245, 265; D21/457
See application file for complete search history.

(56) References Cited

U.S. PATENT DOCUMENTS

| | | | | |
|---|---|---|---|---|
| 4,380,885 | A | 4/1983 | Komagata | |
| 4,915,666 | A * | 4/1990 | Maleyko | 446/242 |
| D399,969 | S | 10/1998 | Lin | |
| 6,309,273 | B1 | 10/2001 | Kim | |
| 6,497,603 | B1 * | 12/2002 | Magers et al. | 446/242 |
| 6,648,717 | B1 | 11/2003 | Dignitti et al. | |

* cited by examiner

*Primary Examiner* — Loan H Thanh
*Assistant Examiner* — Jennifer M Deichl
(74) *Attorney, Agent, or Firm* — Kilpatrick Townsend & Stockton LLP; Dean W. Russell

(57) ABSTRACT

Devices such as exercise hoops are detailed. The hoops may include multiple, serially-connected sections designed to receive internal weights and configured so as to accept both differing numbers and masses of weights as desired. At least some sections, furthermore, may comprise multiple detachable pieces, with complementary pieces exposing one or more weight-receiving compartments when detached.

6 Claims, 3 Drawing Sheets

WEIGHTED EXERCISE HOOPS

CROSS-REFERENCE TO RELATED APPLICATION

This application claims the benefit of U.S. Provisional Application Ser. No. 61/425,345, filed Dec. 21, 2010, titled "Weighted Exercise Hoops," the entire contents of which are hereby incorporated by reference.

FIELD OF THE INVENTION

This invention relates to equipment for exercising and recreational activities and more particularly, although not necessarily exclusively, to multi-section hoops that may be weighted in either uniform or non-uniform manners without necessarily increasing either the overall or sectional diameters of the hoops.

BACKGROUND OF THE INVENTION

U.S. Pat. No. 4,380,885 to Komagata illustrates a "hoop toy" formed of "multiple detachable arc segments." The segments may be hollow or solid; in either circumstance, however, each segment is at all times identical to all others forming the hoop. A receptacle at one end of each segment receives a projection at the other end of an adjacent segment, allowing assembly of the hoop. As noted in the Komagata patent, because the segments are detachable, the hoop may be disassembled for storage or transport.

U.S. Pat. No. 6,309,273 to Kim discloses another hoop formed of multiple arcuate segments or modules. Connected serially using plugs and sockets, the modules include "bulged portions" with "pressure domes" attached to their apexes. "Contact tips" in the forms of magnets and jade are "provided at the tip of each pressure dome" to furnish "magnetic message" and "vital wave vibration" effects.

The contents of the Komagata and Kim patents are incorporated herein in their entireties by this reference. Absent, however, from these existing toys and therapeutic devices is any ability to weight hoops internally for exercising and other purposes. Likewise absent in these hoops is any capability to weight individual segments differently.

SUMMARY OF THE INVENTION

The present invention provides such hoops. Unlike existing multi-section hoops, those of the present invention are designed to receive internal weights and configured so as to accept both differing numbers and differing amounts (masses) of weights. Accordingly, hoops of varying mass may be created using only a single tool or mold.

At least some sections—and preferably each section—of the hoops, furthermore, may comprise multiple detachable pieces. When detached, complementary pieces expose one or more weight-receiving compartments. By positioning weights in various of the compartments, reattaching complementary pieces of a section, and serially attaching multiple sections, a weighted hoop may be formed.

At least one embodiment of the invention includes eight sections of equal length and curvature, each section thus forming an arc circumscribing an angle of approximately forty-five degrees. In this embodiment each section also is tubular and formed of two complementary, attachable pieces, at least one (if not both) of the pieces having hollow regions for receiving weights. Walls may segregate hollow regions into compartments, which preferably are sized and shaped to receive weights snugly.

Although complementary attachable pieces of a section may generally be symmetric about a central axis of the arc, the two pieces beneficially are not necessarily identical. Instead, one piece preferably includes an extended, closed end for additional assembly strength. When two sections are connected, the closed end of one piece may receive a reduced-diameter end of an adjacent section, with a spring-biased button connecting the adjacent sections together. Of course, persons skilled in the relevant art will recognize that other or additional connection means may be employed and that hoop sections may be structured differently than expressly described herein. Equally clear is that "hoops" of the present invention need not necessarily be circular, although presently-preferred versions are indeed circularly configured.

It thus is an optional, non-exclusive object of the present invention to provide weighted hoops for exercising and other purposes.

It is an additional optional, non-exclusive object of the present invention to provide hoops comprising multiple attachable sections.

It is also an optional, non-exclusive object of the present invention to provide hoops in which one or more of the sections are configured to receive weights internally within their volumes.

It is another optional, non-exclusive object of the present invention to provide hoops in which weights of differing mass, shape, or both may, if desired, be placed in different sections.

It is a further optional, non-exclusive object of the present invention to provide hoops in which each section may be formed of multiple pieces detachable to expose weight-receiving areas.

It is, moreover, an optional, non-exclusive object of the present invention to provide hoops in which one piece of a section may have a closed end for added strength at an assembly point with an adjacent section.

Other objects, features, and advantages of the present invention will be apparent to those skilled in appropriate fields with reference to the remaining text and the drawings of this application.

DETAILED DESCRIPTION

Figure 1:
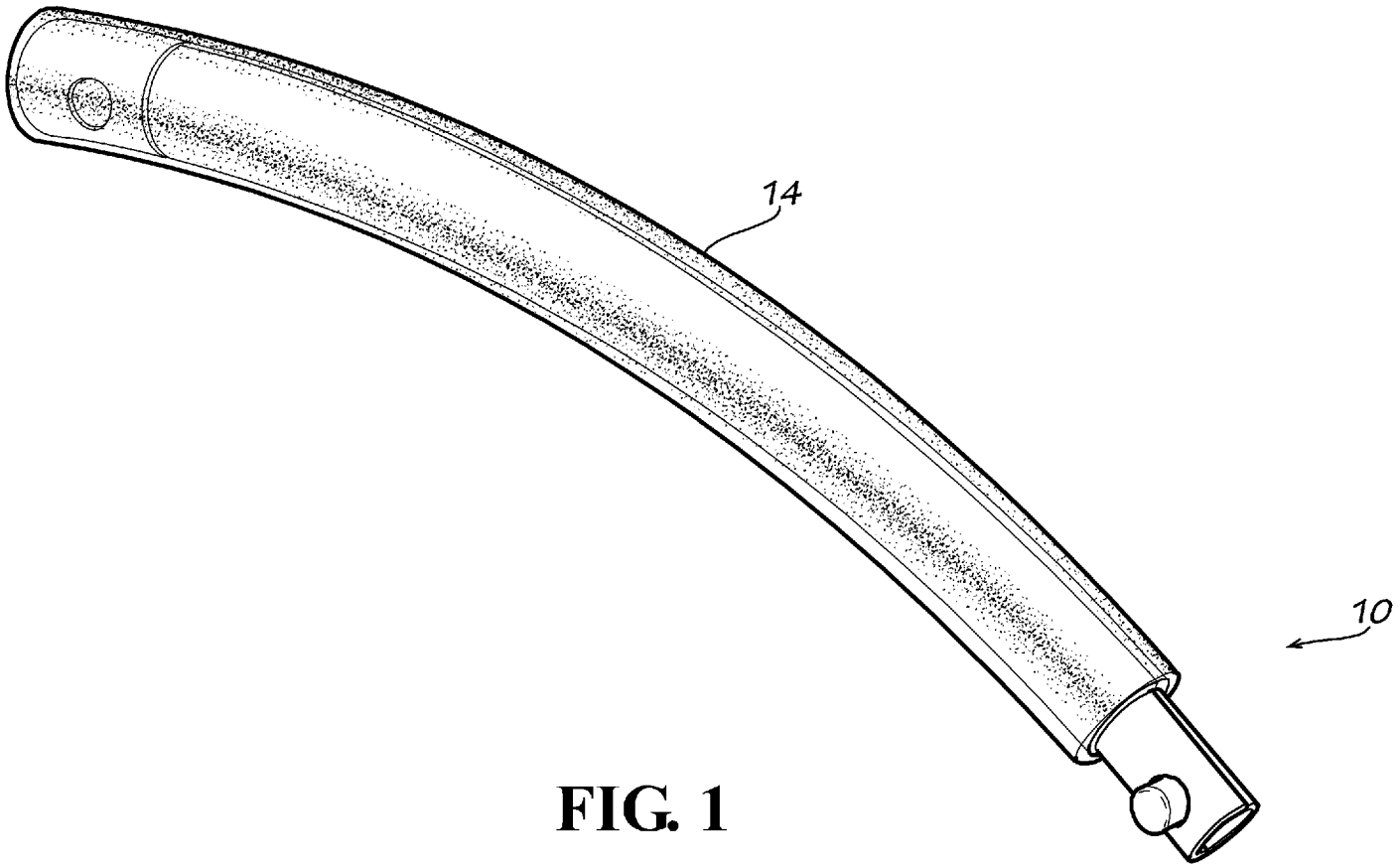
FIG. 1 is a perspective view of an exemplary hoop section of the present invention.
Figure 2:
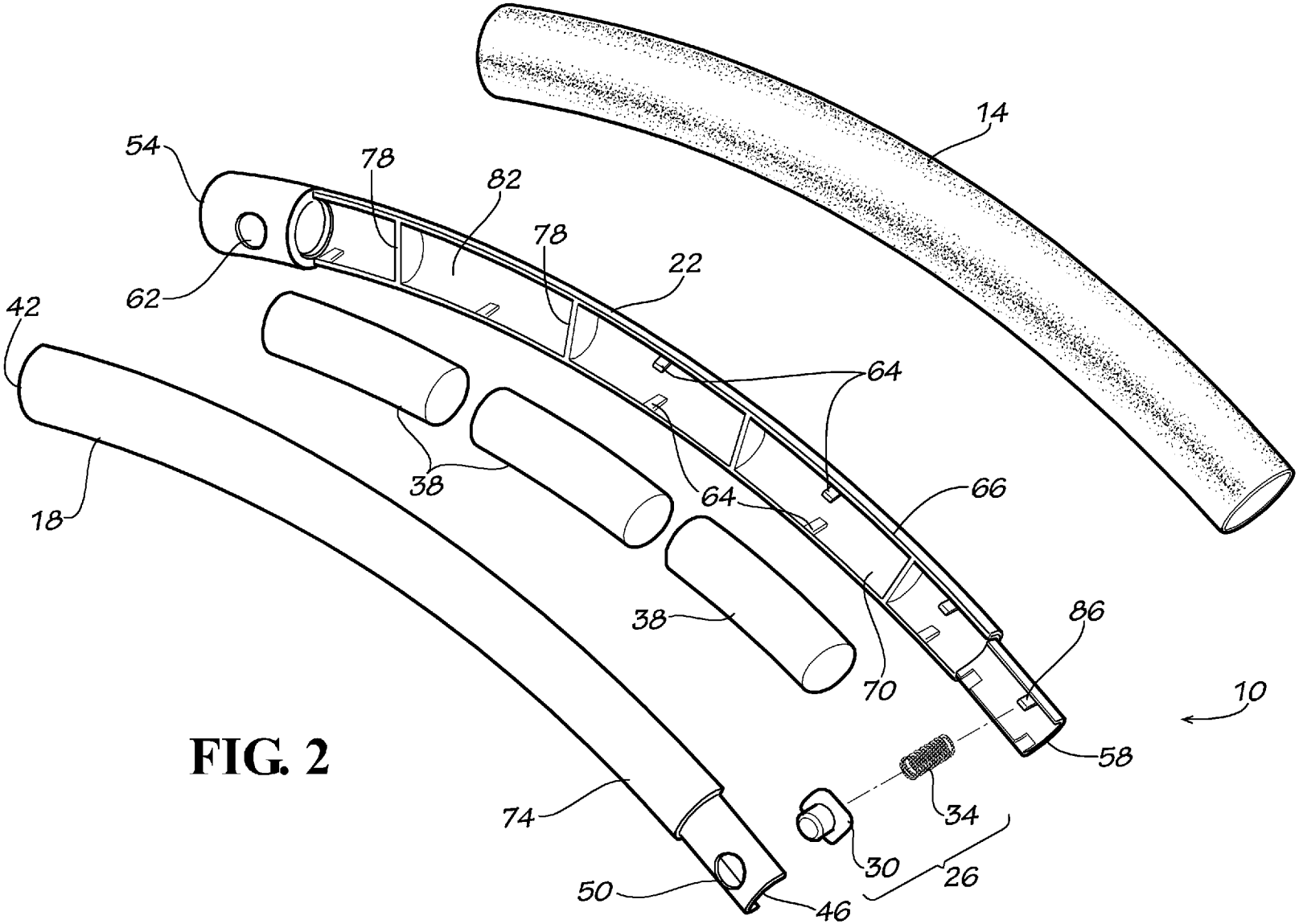
FIG. 2 is an exploded view of the section of FIG. 1.
Figure 3A:
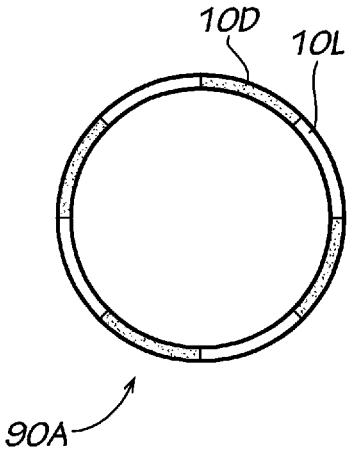
FIGS. 3A-E are plan views of exemplary hoops formed of sections such as those of FIGS. 1-2, with the hoops partially schematicized to illustrate, via shading, differing masses of weights present in different sections.
Figure 3B:
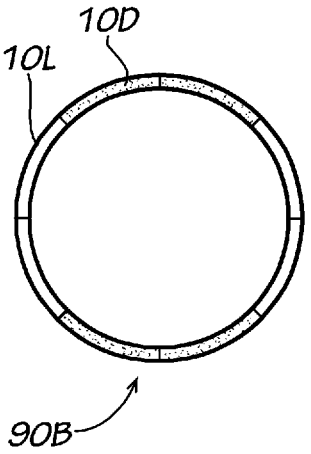
Figure 3C:
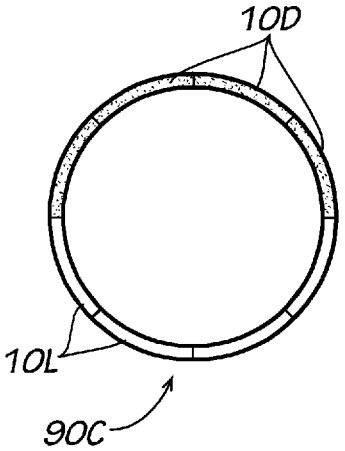
Figure 3D:
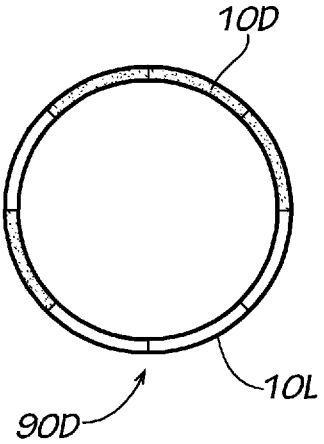
Figure 3E:
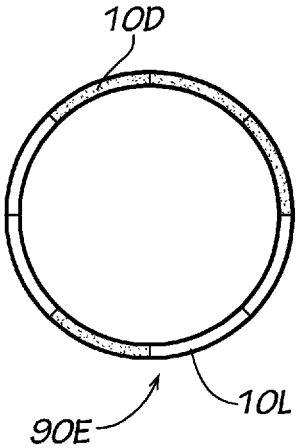

FIGS. 1-2 depict exemplary section 10 consistent with the present invention. Also illustrated in these figures is optional cover 14, which may surround some or all of section 10. When present, cover 14 preferably comprises an arcuate foam tube, although other types, shapes, and compositions of covers may be utilized instead.

As shown in FIG. 2, section 10 may comprise first and second pieces 18 and 22, respectively. Section 10 additionally preferably comprises locking mechanism 26 including, for example, release button 30 and coil spring 34. Further depicted in FIG. 2 are weights 38; although three such weights 38 appear in the figure, any number from none to many weights 38 may be employed at any time in connection with any particular section 10.

First piece 18 beneficially may comprise approximately one-half of an arcuate tube of predetermined radius. Piece 18 defines first end 42 and second end 46, the latter of which has reduced radius. Second end 46 additionally may include opening 50 through which release button 30 may protrude when section 10 is assembled.

Second piece 22 likewise may comprise approximately one-half of an arcuate tube having predetermined radius exactly or approximately equal to that of first piece 18. Piece 22 similarly defines first end 54 and second end 58, the latter of which has reduced radius. Unlike first end 42 of piece 18, however, first end 54 advantageously is tubular for added assembly strength. First end 54 further may include opening 62 for receiving a release button 30 of an adjacent section 10 when a hoop is formed.

First and second pieces 18 and 22 are complementary and designed to be attached as part of section 10. Such attachment may be frictional or made in any appropriate manner, with FIG. 2 illustrating protrusions 64 configured to be frictionally received by corresponding openings of first piece 18. Preferably, though, the attachment is not permanent, so that first and second pieces 18 and 22 may be detached when desired.

Second piece 22 further may define outer surface 66 and inner surface 70, while first piece defines outer surface 74 and an inner surface not visible in FIG. 2. When pieces 18 and 22 are attached (as shown in FIG. 1), the generally tubular area bounded by their inner surfaces forms an internal cavity or volume in which weights 38 may be placed. If desired walls 78 may be formed in connection with inner surface 70 (and the inner surface of piece 18) so as to divide the volume into one or more weight-receiving compartments 82. Advantageously compartments 82 are of the same size and shape, although such equal sizing and shaping is not absolutely necessary.

In illustrated versions of section 10, weights 38 themselves are shaped and sized so as to fit snugly in compartments 82. For this purpose each weight 38 may be in the form of a bag with generally tubular shape. Weights 38 may assume other forms, however, consistent with the invention. Notably, though, weights 38 need not necessarily have equal mass. Likewise, not all compartments 82 need necessarily be fitted with weights 38 at any given time.

Finally, protruding from inner surface 70 at second end 54 may be prong 86. The prong 86 forms a base for locking mechanism 26, being received by coil spring 34 and extending into a recess in button 30. Bases other than prong 86 undoubtedly may be used instead, however. To connect two sections 10, attached second ends 46 and 58 (with reduced radius) of one section 10 may simply be inserted into end 54 of an adjacent section 10. Such insertion will eventually bear on button 30 (hence depressing spring 34) until openings 50 and 62 are aligned. At this point button 30 is able to protrude through both openings 50 and 62, thus limiting further relative movement of the two sections 10 until depressed.

FIGS. 3A-E illustrate multiple sections 10 serially connected to form hoops 90A-E. As depicted, each hoop 90A-E comprises eight identical sections 10, with each section circumscribing an angle of approximately forty-five degrees. Accordingly, as connected, the sections 10 create an annular structure in the form of a hoop, with each such hoop 90A-E being of the same size and shape.

Notwithstanding that their shapes and sizes are similar, hoops 90A-E may be weighted differently. These differences may be in masses of weight, in distributions of weight, or in both masses and distributions. FIGS. 3A-E illustrate examples of exemplary differences schematically, with darker-colored sections 10D having a first mass M1 and lighter-colored sections 10L having a mass M2 different from M1. Although as illustrated the overall mass of each hoop 90A-E is the same (=4M1+4M2), distributions of the mass clearly differ.

For example, hoop 90A alternates sections 10D and 10L, effectively spacing each type of section (10D or 10L) approximately ninety degrees from its closest neighbor of the same type. As hoop 90A rotates about a user's waist or hips, therefore, the user will encounter alternating masses M1 and M2 (e.g., M1, M2, M1, M2, M1, M2, M1, M2). In this instance, weighting of hoop 90A is symmetric about multiple diameters D of the hoop.

Weighting of hoop 90B likewise is symmetric about at least some diameters of the hoop. However, each section 10D now abuts both another section 10D and a section 10L. Hence, as a user rotates hoop 90B about his or her waist or hips, he or she will encounter a different weighting distribution of, e.g., M1, M1, M2, M2, M1, M1, M2, M2.

Yet again, weighting of hoop 90C is symmetric about at least one diameter of the hoop. In this version, though, four sections 10D are adjoined in series, as are four sections 10L. Accordingly, rotation of hoop produces a weighting distribution of, e.g., M1, M1, M1, M1, M2, M2, M2, M2 encountering the user's waist or hips.

Weighting of hoops 90D and 90E, by contrast, is not symmetric about any hoop diameter. Distribution within hoop 90D, for example, may follow an exemplary pattern of M1, M1, M1, M2, M1, M2, M2, M2. Exemplary pattern M1, M1, M1, M2, M2, M1, M2, M2 may occur through rotation of hoop 90E. Persons skilled in the art will recognize that other weight distribution patterns may be created by interconnecting sections 10D and 10L.

By making sections 10 identical and varying weight mass and distribution separately, the present invention allows a single tool or mold to create the sections 10 capable of connecting to create numerous differing hoops. This flexibility provides a low-cost approach to manufacturing hoops useful for a variety of purposes and exercise routines. Because pieces 18 and 22 are both detachable and reattachable, furthermore, changes to the weighting of any individual section 10 may be made quickly and easily.

The foregoing is provided for purposes of illustrating, explaining, and describing embodiments of the present invention. Modifications and adaptations to these embodiments will be apparent to those skilled in the art and may be made without departing from the scope or spirit of the invention.

What is claimed is:

1. An exercise hoop comprising:

a. a first section generally in the form of an arcuate tube (i) having a nominal radius and (ii) defining (A) a first end and (B) a second end of reduced radius;

b. a second section generally in the form of an arcuate tube (i) having a nominal radius and (ii) defining (A) a first end and (B) a second end of reduced radius;

c. first weight having mass M1 (i) inserted into the first section and (ii) configured to fit snugly therein; and d. second weight having mass M2 (i) inserted into the second section and (ii) configured to fit snugly therein; and wherein mass M1 is not equal to mass M2 and the second end of the first section is inserted into the first end of the second section.

2. An exercise hoop according to claim 1 in which the first section comprises a locking mechanism.

3. An exercise hoop according to claim 2 in which the second section comprises a locking mechanism.

4. An exercise hoop according to claim 3 in which the locking mechanism of the first section comprises a button and the locking mechanism of the second section comprises an opening for receiving the button.

5. An exercise hoop according to claim 4 in which the nominal radius of the arcuate tube of the first section is the same as the nominal radius of the arcuate tube of the second section.

6. An exercise hoop according to claim 5 further comprising (a) a third section generally in the form of an arcuate tube having a nominal radius and (b) a third weight having mass M3 inserted into the third section and configured to fit snugly therein, wherein mass M3 is not equal to at least one of mass M1 and mass M2.

* * * * *